US008910840B2

(12) United States Patent
Kamo et al.

(10) Patent No.: US 8,910,840 B2
(45) Date of Patent: Dec. 16, 2014

(54) SHOULDER HARNESS FOR PORTABLE WORKING MACHINE

(71) Applicant: Yamabiko Corporation, Tokyo (JP)

(72) Inventors: Keita Kamo, Tokyo (JP); Masayoshi Miyamoto, Tokyo (JP); Osamu Tada, Tokyo (JP); Mitsutane Chiba, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 0 days.

(21) Appl. No.: 13/866,144

(22) Filed: Apr. 19, 2013

(65) Prior Publication Data

US 2013/0277408 A1 Oct. 24, 2013

(30) Foreign Application Priority Data

Apr. 19, 2012 (JP) ..... 2012-095771

(51) Int. Cl.
*A45F 3/14* (2006.01)

(52) U.S. Cl.
USPC ..... 224/268; 224/150; 224/157; 224/160

(58) Field of Classification Search
CPC ..... A45F 3/14; A45F 5/02; A45F 2003/142; A45F 2003/146; A45F 2003/148
USPC ..... 224/269, 268, 150, 157, 160, 162
See application file for complete search history.

(56) References Cited

U.S. PATENT DOCUMENTS

| | | | | |
|---|---|---|---|---|
| 4,986,458 | A * | 1/1991 | Linday | 224/160 |
| 5,071,047 | A * | 12/1991 | Cordisco | 224/158 |
| 5,692,655 | A * | 12/1997 | Fair et al. | 224/160 |
| 5,813,580 | A * | 9/1998 | Fair | 224/160 |
| 5,913,464 | A | 6/1999 | Haberlein | |
| 6,247,624 | B1 | 6/2001 | Rundberg | |
| 7,669,743 | B2 * | 3/2010 | Bruton | 224/159 |
| 2001/0030210 | A1 * | 10/2001 | Donine | 224/160 |
| 2002/0020723 | A1 * | 2/2002 | Lindsey | 224/150 |
| 2002/0148866 | A1 * | 10/2002 | Dent, III | 224/259 |
| 2004/0031827 | A1 * | 2/2004 | Haber | 224/160 |
| 2004/0149790 | A1 * | 8/2004 | Kassai et al. | 224/160 |
| 2005/0051582 | A1 * | 3/2005 | Frost | 224/160 |

(Continued)

FOREIGN PATENT DOCUMENTS

| | | |
|---|---|---|
| EP | 1661446 A1 | 5/2006 |
| JP | 2005-143453 | 6/2005 |

(Continued)

OTHER PUBLICATIONS

Extended European Search Report issued in corresponding European Patent Application No. 13164487.4 dated Jul. 29, 2013 (5 pages).

*Primary Examiner* — Brian D Nash
(74) *Attorney, Agent, or Firm* — Kilyk & Bowersox, P.L.L.C.

(57) ABSTRACT

A shoulder harness includes a harness network (102) composed of right and left shoulder belts (104) and a side-fitting belt (114) for fitting on the left side of an operator's chest and joining at one end with front ends of the shoulder belts (104) on a stomach area of the operator. The shoulder harness further includes an intermediary member (120) connected to the harness network (102) via a holding member (122) and supporting a hook (108) for retaining a working machine. The right and left shoulder belts (104) are shaped asymmetric such that a shoulder-fitting portion (110Le) of the left shoulder belt (104Le) curves or slants toward the working machine retained on the hanging element (108).

8 Claims, 10 Drawing Sheets

(56) References Cited

U.S. PATENT DOCUMENTS

| | | | | |
|---|---|---|---|---|
| 2005/0155996 | A1* | 7/2005 | Hiscocks | 224/160 |
| 2005/0184114 | A1* | 8/2005 | Hoff et al. | 224/160 |
| 2008/0190972 | A1* | 8/2008 | Gray | 224/160 |
| 2009/0071990 | A1* | 3/2009 | Jardine et al. | 224/155 |
| 2009/0090754 | A1* | 4/2009 | Haberlein | 224/262 |
| 2009/0230164 | A1* | 9/2009 | Freeman | 225/78 |

FOREIGN PATENT DOCUMENTS

| | | | |
|---|---|---|---|
| WO | 2008076010 | A1 | 6/2008 |
| WO | 2008147256 | A1 | 12/2008 |
| WO | 2009098602 | A1 | 8/2009 |

* cited by examiner

SHOULDER HARNESS FOR PORTABLE WORKING MACHINE

FIELD OF THE INVENTION

The present invention relates to a shoulder harness destined to support a portable working machine such as brush cutters, hedge trimmers, pruners or the like.

BACKGROUND OF THE INVENTION

Such a portable working machine is normally carried by an operator in operation with the machine, and its weight would be a considerable load to the operator's arms. To alleviate the load to the operator's arms, shoulder harnesses are used. These shoulder harnesses, in general, are configured to surround the chest of an operator, and composed of a harness network that includes at least a back-fitting member to be worn on the operator's back, and right and left shoulder belts connected to the back-fitting member.

FIG. 6 schematically illustrates a shoulder harness disclosed in Patent Document 1, which is referred to as a first existing harness hereafter. The first existing shoulder harness 1 shown in FIG. 6 includes a side-fitting belt 11 connected to a back plate (back-fitting member) 2, and the side-fitting belt 11 joins at the front end thereof with distal ends of right and left shoulder belts SB in front of the operator, thereby forming a harness network 4. The side-fitting belt is a member that should fit one side of an operator's chest when the operator wears the shoulder harness. In connection with the harness network 4, a hook 8 as a hanging element is held on a hip pad 5. A working machine (not shown) can be removably held in engagement with the hook 8. More specifically, a laterally extending tunnel-like guide 5*a* is provided near the upper end of the hip pad 5. A suspension string 6 is inserted to pass through the tunnel-like guide hole or loop 5*a* is, and one end thereof is connected to the back-fitting member 2. The opposite end of the suspension string 6 is connected to the side-fitting belt 11. The hip pad 5 is also connected to the back-fitting member 2 via a suspension belt 7 that acts as a second suspension member.

FIG. 7 schematically illustrates a shoulder harness disclosed in Patent Document 2, which is referred to as a second existing shoulder harness hereafter. The second existing shoulder harness 10 shown In FIG. 7 has a harness network 13 including a first diagonal belt 11A that is connected to an upper end portion of a back-fitting member 2 and extends therefrom diagonally. The first diagonal belt 11A extends from the upper end of the back-fitting member 2 diagonally downward along the left side of an operator's chest until reaching a front portion of the operator, and joins the waist belt 12 there. Thus, the first diagonal belt 11A substantially acts as a side-fitting belt. The waist belt 12 extends across the back-fitting member 2 to include an extension 12*a* that is a part beyond the back-fitting member 2 and extends along the right side of the operator's body. The extension 12*a* is connected at the right front end thereof to a second diagonal belt 11B that extends diagonally from the upper end of the back-fitting member 2. A hook 8 held on a hip pad 5 is connected to the harness network 13 via two suspension belts 14 and 15, front and rear. More specifically, the front suspension belt 14 is connected to the juncture of the first diagonal belt 11A and the waist belt 12, while the rear suspension belt 15 is connected to the juncture of the extension 12*a* of the waist belt 12 and the right one of the shoulder belts SB.

FIG. 8 schematically illustrates a shoulder harness disclosed in Patent Documents 3 and 4, which is referred to as a third existing shoulder harness hereafter. The third existing shoulder harness 20 shown in FIG. 8 includes a waist belt 3 and a side-fitting belt 11 connected to a back-fitting member 2 such that these three elements make a harness network 21. A hook 8 held on a hip pad 5 is connected to the harness network 21 via two suspension belts 14 and 15, front and rear. The front suspension belt 14 is connected to the front end of the side-fitting belt 11, while the rear suspension belt 15 is connected to the back-fitting member 2. As shown in FIG. 8, the shoulder harness 20 further includes a releasable joint buckle 16 that is to be positioned on the breast of an operator.

FIG. 9 schematically shows a shoulder harness disclosed in Patent Document 5, which is referred to as a fourth existing shoulder harness hereafter. The fourth existing shoulder harness 30 shown in FIG. 9 includes a back-fitting member 2 and two side-fitting belts 31 and 32, right and left, which are connected to the back-fitting member 2 such that these three elements make a harness network 33. A hip pad 5 having a hook 8 thereon is connected to the harness network 33 via two suspension belts 14 and 15, front and rear. The front suspension belt 14 is connected to the front end of the side-fitting belt 31, while the rear suspension belt 15 is connected to the back-fitting member 2.

LIST OF LITERATURES

[Patent Document 1]
WO 2008/076010 A1
[Patent Document 2]
U.S. Pat. No. 5,913,464
[Patent Document 3]
U.S. Pat. No. 6,247,624
[Patent Document 4]
WO 2008/147256 A1
[Patent Document 5]
JP 2005-143453 A

SUMMARY OF THE INVENTION

Problems to be Solved by the Invention

The conventional shoulder harnesses are so shaped that the right and left shoulder belts SB have symmetric geometries and both extend straight. This is discussed below with reference to FIG. 10 that shows a schematic diagram showing the basic structure of the shoulder harness disclosed in Patent Document 4. FIG. 10 is a view taken from eyes of an operator P who wears the shoulder harness shown in FIG. 8.

Shoulder belts SB, in general, are composed of a shoulder portion 18 intended to fit an operator's shoulder, and a band 19. The shoulder portion 18 is made up of a core or bone member and pad. The shape of the shoulder portion 18 is limited regulated by the core member. As shown in FIG. 10, the shoulder portions 18 of the conventional shoulder belts SB are formed bilaterally symmetric and extend straight from the shoulders of the operator P.

Still referring to FIG. 10, front ends of the right and left shoulder belts SB are connected to each other via a joint buckle 16. A hook (hanging element) 8 (on a hip pad 5) is connected as well to the joint buckle 16 via a front suspension belt 14. The hook 8 is also connected to a back-fitting member 2 via a rear suspension belt 15. The front and rear suspension belts 14 and 15 are made of relatively long and wide bands. Thus, the operator P can freely move a working machine hung on the hook 8. The working machine hung on the hook 8 produces a pulling force caused by its weight. This pulling force first acts on the front suspension belt 14 or rear suspension belt 15, and it is transmitted via the joint buckle 16 mainly to the left shoulder belt SB(Le) on the opposite sides from the working machine (hook 8) as a diagonally lower right force F (directed to the hook 8). The pulling force F applied to the right suspension belt 14 changes as the operator moves the working machine.

When the pulling force F acts on the left shoulder belt SB(Le) opposite from the side of the operator's body where the working machine is retained, the shoulder portion 18 of the left shoulder belt SB(Le) is hauled and slithered to the right toward the operator's neck while deforming somewhat. More specifically, the shoulder portion 18 of the left shoulder belt SB(Le) shifts from its proper position, along with bending deformation of its core or bone element, while applying a constrictive pressure to the neck of the operator P. Such deformation and displacement of the shoulder portion 18 of the left shoulder belt SB (Le) vary with changes in pulling force F applied to the front suspension belt 14 during operation with the working machine by the operator. This phenomenon not only makes the operator P uncomfortable but also causes larger load to the operator's left shoulder. This will inevitably invites cumulative fatigue of the operator P in operation with the working machine.

It is therefore an object of the invention to provide a shoulder harness having right and left shoulder belts for use with a working machine and capable of limiting deformation and displacement of one of the shoulder belts at one side opposite from the working machine to reduce the load applied to the operator's shoulder from the working machine.

Means for Solution of the Problems

The object of the invention is accomplished by a shoulder harness having a harness network composed of at least a back-fitting member to be worn on the back of an operator and right and left shoulder belts to be worn on the right and left shoulders of the operator, and having a hanging element connected to the harness network, such that a working machine can be retained on the hanging element, comprising:

the right and left shoulder belts having an asymmetric configuration: and a shoulder-fitting portion of one of said shoulder belts intended to be worn on an operator's shoulder, which is opposite from one side where the working machine should be retained on the hanging element, being curved or slanted toward a direction of a pulling force applied to said shoulder belt from said working machine.

In the shoulder harness according to the present invention, the shoulder portion of the shoulder belt opposite from the working machine is curved or slanted in the direction of the pulling force applied to the shoulder belt. Therefore, even if the pulling force acts on the shoulder belt opposite from the working machine along with a movement of the working machine, displacement and deformation of the shoulder portion of the shoulder belt, caused by the application of the pull force, can be reduced. Thus, the shoulder belt can keep properly fitting on the operator's shoulder, and relieves the operator from the excessive load to his shoulders.

DETAILED DESCRIPTION OF THE INVENTION

The present invention will be described in detail below by way of embodiments thereof with reference to the accompanying drawings FIGS. 1 to 5. These embodiments, however, should not be construed to limit the present invention. Through the description of the present invention, the terms "right" and "left" pertain to right and left sides respectively as viewed from an operator wearing the shoulder harness in its intended way, and the terms "front" and rear" pertain to front and rear sides respectively as viewed from the operator.

Figure 1:
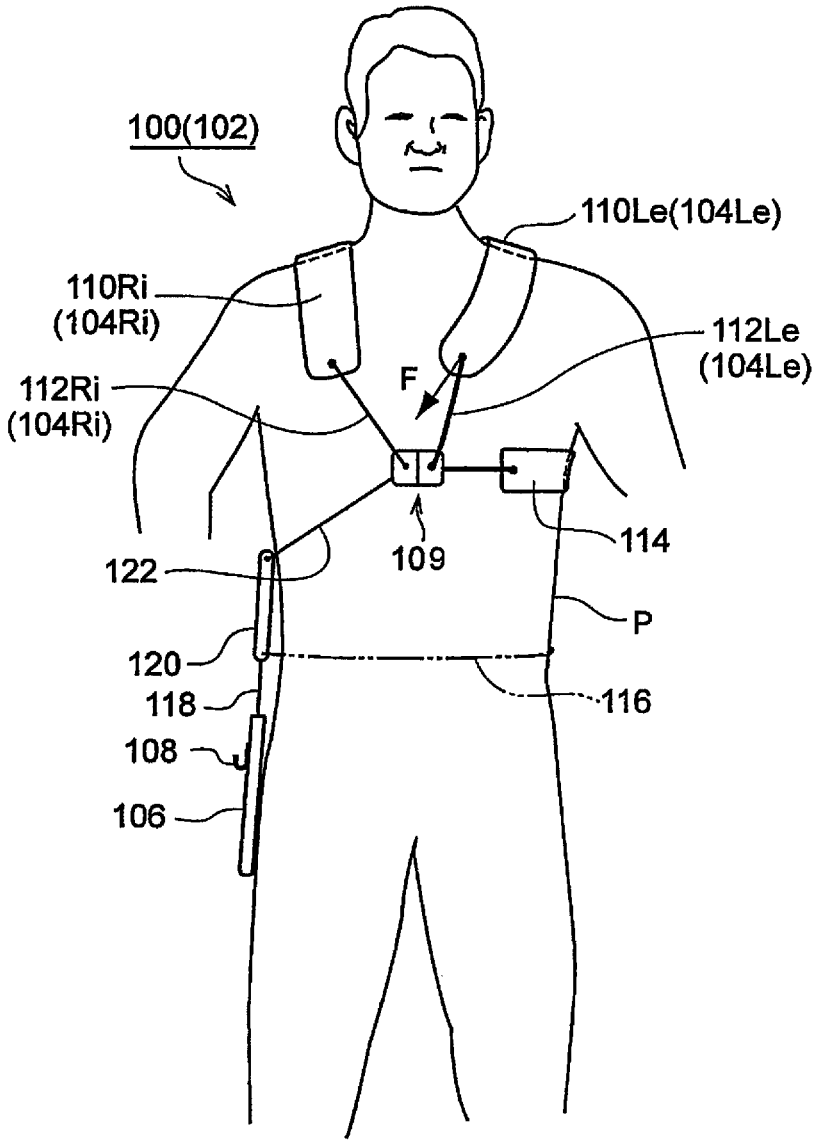
FIG. 1 illustrates a basic configuration proposed by the present invention.
Figure 10:
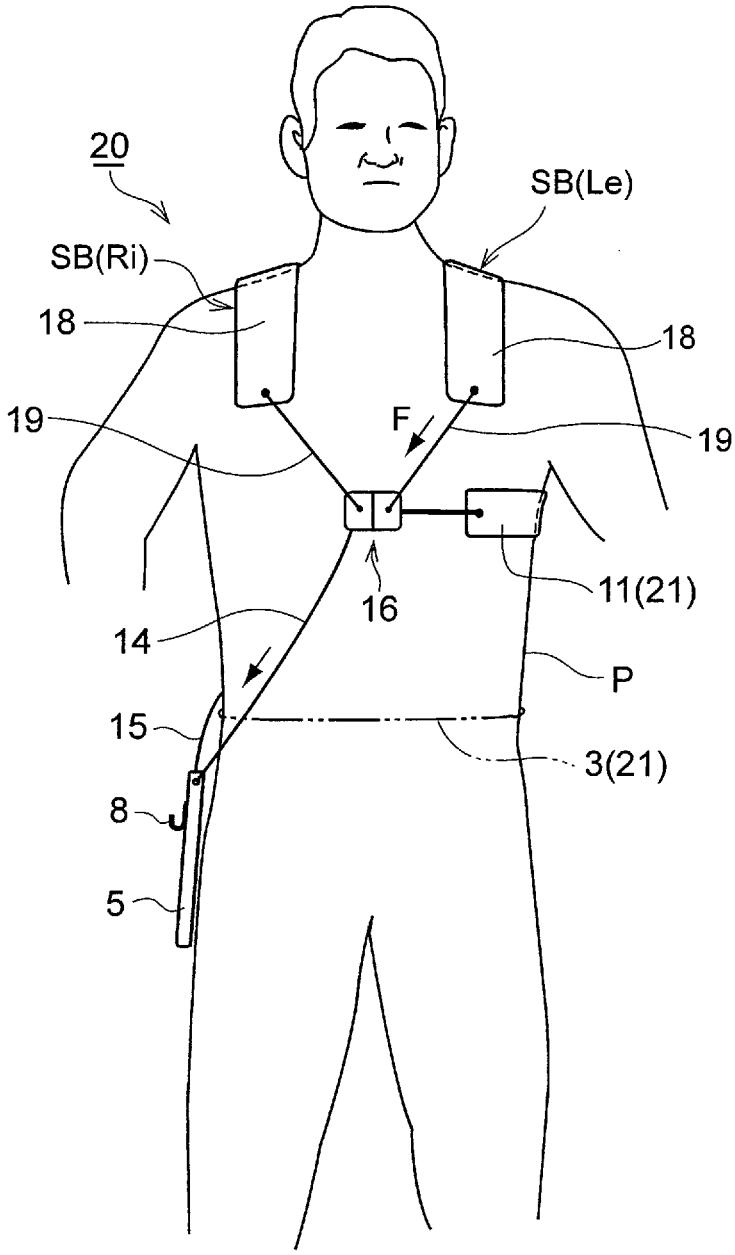
FIG. 10 is a view for explaining problems derived from right and left shoulder belts included in the existing shoulder harnesses.

With reference to FIG. 1, the shoulder harness 100 according to the present invention includes right and left shoulder bests 104 as components of a harness network 102. Referring to FIG. 1 in comparison with FIG. 10 for better understanding, the right shoulder belt 104Ri on one side of an operator's body, where a working machine (and a hanging element 108 held on a hip pad 106) will be connected, has a shoulder portion 110Ri that extends straight like those in existing shoulder harnesses. A wide band 112Ri extends from the shoulder portion 110Ri and it is connected to a joint buckle 109. On the other hand, the right should belt 104Le on the opposite sides, which is opposite from the said one side for connection of the working machine, has a shoulder portion 110Le that extends diagonally or curves to the right. That is, the right and left shoulder belts 104Ri, 104Le are asymmetric.

Although it is optional, the shoulder harness 100 may include a side-fitting belt 114 positioned on the side opposite from the working machine. Similarly, the shoulder harness 100 may include a waist belt 116 connected to a back-fitting member. More preferably, the shoulder harness 100 may include an intermediary plate 120 as an intervening member to support the hook 108 via a suspension belt 118, and the intermediary plate 120 may be connected to the harness network 102 via a holding member 122.

The concept of the right and left shoulder belts employed in the shoulder harness according to the invention is applicable to the right and left shoulder belts included in the existing shoulder harnesses explained above in conjunction with FIGS. 6 through 9 to improve these shoulder harnesses.

In the shoulder harness 100 according to the present invention, the left shoulder portion 104Le at the opposite side from the working machine (hip pad 106) extends diagonally or curves to the right. Therefore, even if the pulling force F from the working machine acts on the left shoulder belt 104Le, displacement and deformation of the shoulder portion 110Le of the left shoulder belt 104Le can be diminished, and the operator can be relieved from imbalanced load to the shoulders.

Figure 2:
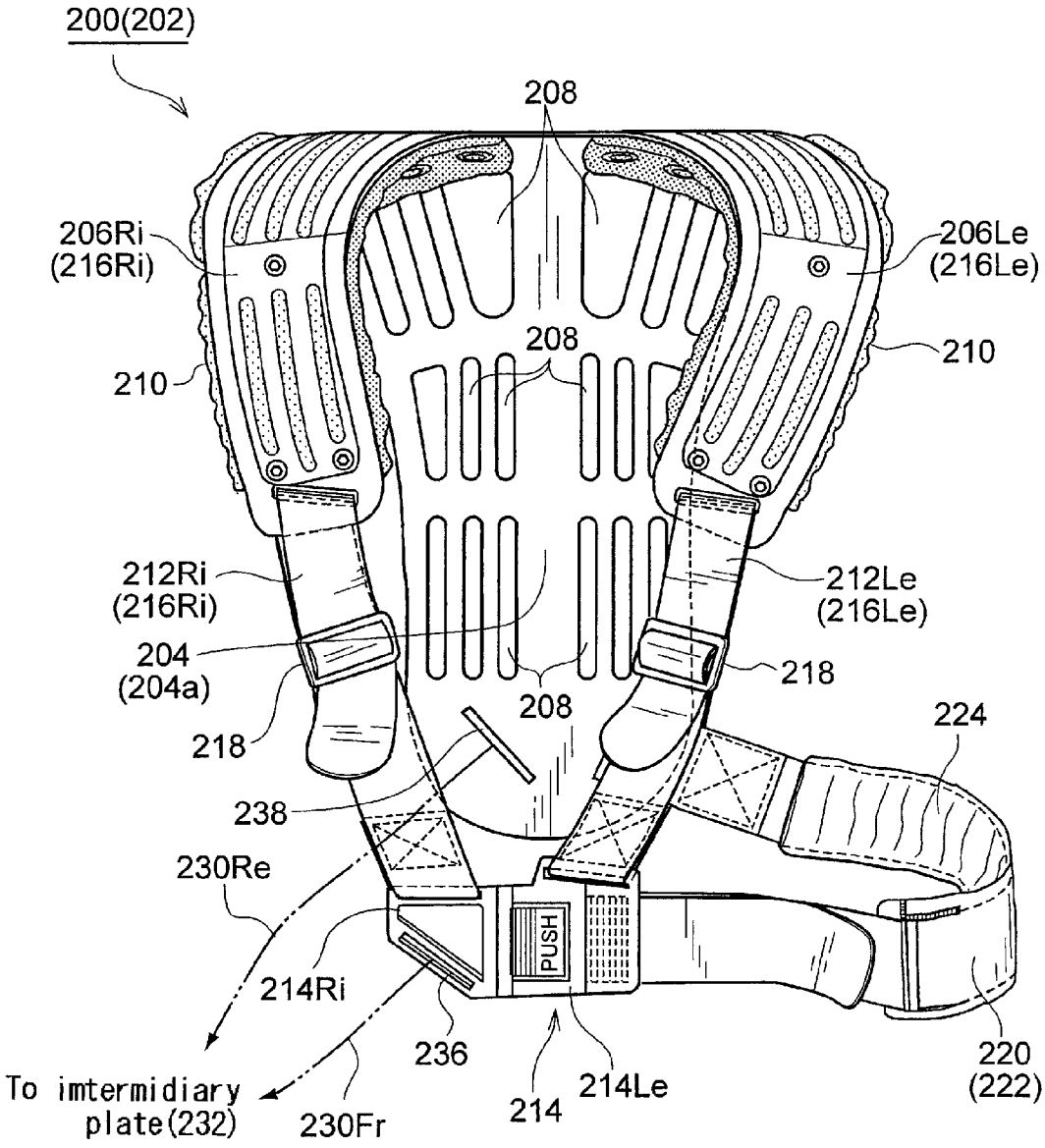
FIG. 2 is a front view of a harness network included in a shoulder harness according to an embodiment of the present invention.
Figure 3:
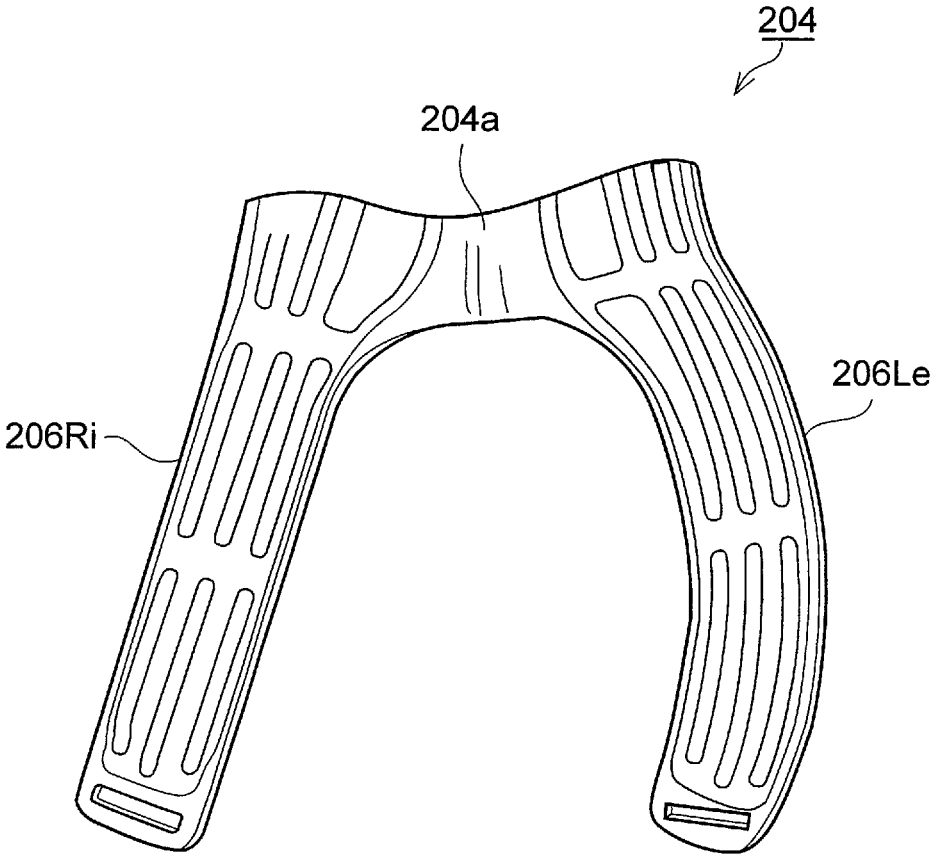
FIG. 3 illustrates shoulder portions that are formed by molding as integral parts of a back plate included in the shoulder harness according to the embodiment.
Figure 4:
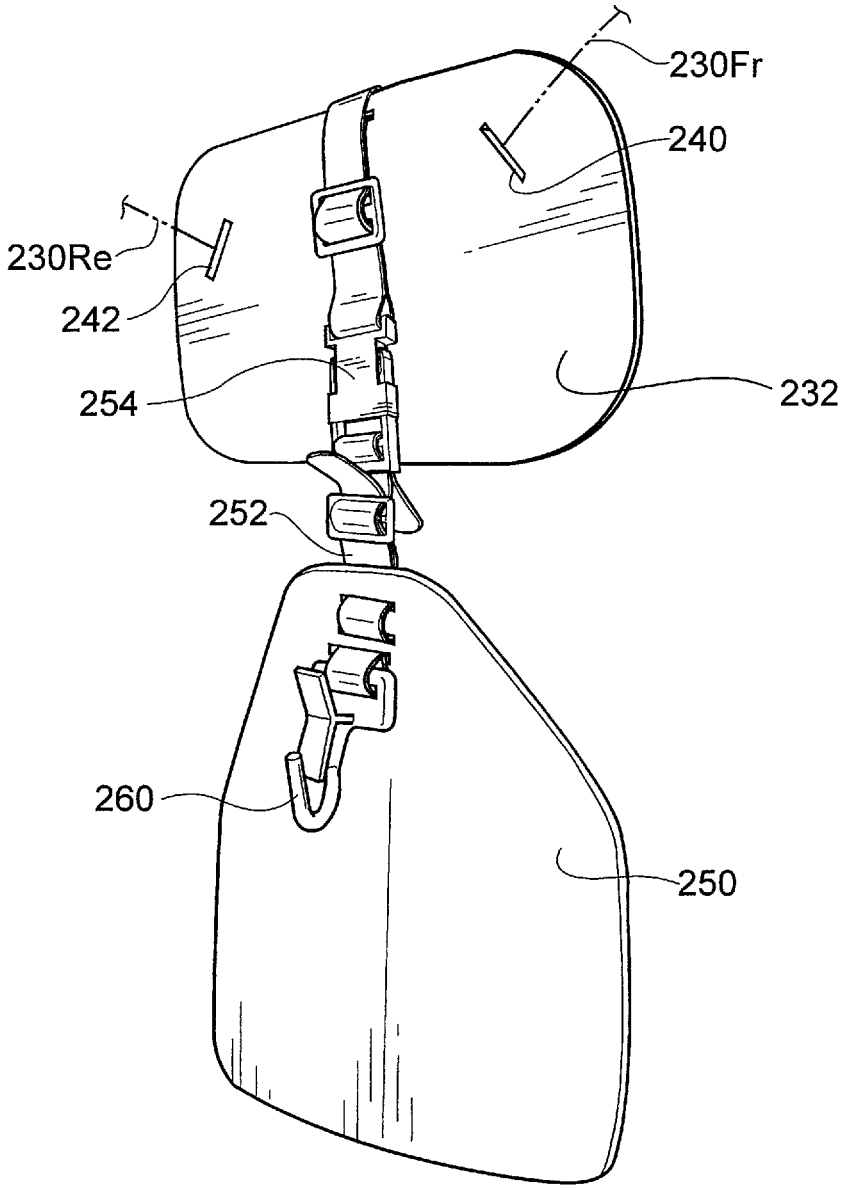
FIG. 4 is a perspective view of an intermediary plate included in the shoulder harness according to the embodiment of the present invention and a hip pad suspended on the intermediary plate.

Embodiment (FIGS. 2 to 4)

FIG. 2 shows a shoulder harness 200 according to an embodiment of the present invention. The shoulder harness 200 includes a harness network 202 that includes a back plate 204 as a back-fitting member to be worn on the back of an operator. The back plate 204 is made by molding a synthetic resin. The back plate 204 has a base body 204*a* and a pair of elongated right and left extensions 206Ri and 206Le integrally formed with the base body 204*a* to extend forward from opposite side portions of the upper end of the body 204*a*. The pair of extensions 206Ri and 206Le is intended to fit on right and left shoulders of the operator. As shown, many aeration openings 208 are formed throughout the entire area of the back plate body 204*a* and right and left extensions 206Ri and 206Le. The back plate 204 having the right and left extensions 206Ri and 206Le may be prepared as an integral mold member of a synthetic resin such as PE, PP, nylon or the like. The right and left extensions 206Ri and 206Le constitute cores or bones of the shoulder-fitting portions of the right and left shoulder belts 216Ri and 216Le. The right and left extensions 206Ri and 206Le are lined with elongated shoulder cushions 210.

From front ends of the right and left extensions 206Ri and 206Le, known wide bands 212 of polyester fibers excellent in tensile strength extend in connection thereto, and these wide bands 212 merge at their front ends. The right resin-made extension 206Ri and right wide band 212Ri connected to the extension 206Ri make up a right shoulder belt 216Ri, while the left resin-made extension 206Le and left wide band 212Le connected to the extension 206Le make up a left shoulder belt 216Le. In a preferred variant, joint buckles 214Le, 214Ri may be provided at front ends of the shoulder belts 216Le, 216Ri. These joint buckles 214Le, 214Ri may be of a known type comprising two separate parts to be releasably mated with each other.

FIG. 3 is a plan view of the right and left extensions 206Ri and 206Le included in the back plate 204. As seen from the illustration, the right and left extensions 206Ri and 206Le extending continuously from the upper end of the body 204*a* of the back plate 204 are bilaterally asymmetric. As best shown in FIG. 3, the left extension 206Le gradually curves to the right toward its distal (front) end whereas the right extension 206Ri extends straight like in existing shoulder harnesses.

Referring back to FIG. 2, The right and left shoulder belts 216Le, 216Ri are provided at their bands 212Ri and 212Le with length-adjusting buckles 218 that enable the right and left shoulder belts 216Ri and 216Le to be adjusted in length independently.

The shoulder harness 200 according to the embodiment preferably includes a side-fitting belt 220 extending laterally and intended to fit the left side of the operator's body. The side-fitting belt 220 is composed of a polyester fiber band 222 and a cushion member 224 stitched on the inner side of the band 222. The side-fitting belt 220 is connected at the rear end thereof to the back plate 204, and at the front end to the left joint buckle 214Le, to be adjustable in length.

In FIG. 2, an imaginary line 230 indicates a holding member with which the harness network 202 and an intermediary member 232 shown in FIG. 4 are connected to each other. The holding member 230 is composed of two separate parts, namely, front and rear holding belts 230Fr and 230Re each being a known wide band of polyester fibers. These rear holding belts 230Fr and 230Re are combined together at their opposed ends by the intermediary plate 232 (see FIG. 4 as well). The other end of the front holding belt 230Fr is connected to the right joint buckle 214Ri, and the other end of the rear holding belt 230Re is connected to the back plate 204.

In FIG. 2, reference numeral 236 denotes a slit formed in the right joint buckle 214Ri. The front holding belt 230Fr is connected to the right joint buckle 214Ri at the slit 236. Reference numeral 238 in FIG. 4 indicates a slit formed in the back plate 204. The rear holding belt 230Re is connected to the back plate 204 at the slit 238. A length-adjusting buckle (not shown) is preferably interposed in each of the front and rear holding belts 230Fr and 230Re.

With reference to FIG. 4, an intermediary plate used as the intermediary member 232 has formed in the upper portion thereof two front and rear slits 240 and 242 that are distant from each other in the front-and-rear direction. These slits 240, 242 are used to connect the front and rear holding belts 230Fr and 230Re to the intermediary member 232.

In FIG. 4, reference numeral 250 denotes a hip pad. The upper end portion of the hip pad 250 is connected to a widthwise intermediate portion of the intermediary plate 232 positioned above the hip pad 250 by a wide belt 252 that acts as a suspension member. As a variant of the embodiment, the hip pad 250 and intermediary plate 232 may be connected to each other by a plurality of suspension belts isolated widthwise of the intermediary plate 232 and connected to the intermediary plate 232. The suspension belt 252 is made of a known wide band of polyester fibers, and preferably includes a length-adjusting buckle or joint buckle 254. As shown in FIG. 4, a known hook 260 is attached to the hip pad 250 to retain a working machine (not shown) hung thereon.

The shoulder harness 200 according to the embodiment shown in FIGS. 2 to 4 is suitable for use with a relatively lightweight working machine. To use the shoulder harness 200 with a relatively heavy working machine, the back plate 204 may be extended downward and a waist belt, adjustable in length, may be connected to the lower end of the extension of the back plate 204. Like conventional ones, the waist belt is preferably composed of right and left two bands made of polyester fibers, and it preferably includes a joint buckle at a location to be opposed to the abdominal center of the operator, where the front ends of the right and left bands are positioned as well. The right band of the waist belt is preferably connected to the intermediary plate 232. As a means for connecting the right band of the waist belt to the intermediary plate 232, a tunnel or loop may be formed on the intermediary plate 232 such that the right band of the waist belt can be inserted in a horizontal orientation. Alternatively, the right band of the waist belt may be fixed onto the intermediary plate 232. As a way of fixing the waist belt to the intermediary plate 232, the intermediary plate may be fixed to a lengthwise intermediate portion of the right band when the right band is a single member. Alternatively, the right band may be composed of two divisional bands to connect the intermediary plate 232 between the two divisional bands. In this case, a rear one of the divisional bands is connected with its front end to the intermediary plate 232 whereas the other front one of the divisional bands is connected with its rear end to the intermediary plate 232.

This modified model of the shoulder harness is suitable for use with a relatively heavy working machine. In case this model is actually used with a relatively heavy working machine, the back plate 204 preferably has a higher rigidity. The right and left shoulder belts 216Ri and 216Le may be bands of synthetic fibers each extending continuously from the back plate 204 to the joint buckle 214. The shoulder harness of this type is described in detail in International Publication No. WO 2008/147256 A1. The entire disclosure of this publication is incorporated in this specification.

With reference to FIG. 3, in the shoulder harness 200 according to the embodiment, the left extension 206Le of the back plate 204, which constitutes a core or bone of the shoulder portion of the left shoulder belt 216Le, curves to the right to point its distal (front) end at the joint buckle 214. Thus, the left shoulder belt 216Le originally has the configuration extending toward the joint buckle 214. More preferably, the left extension 206Le should be designed such that its front part curves or slants to point the distal end (front end) at the intermediary plate 232 (intermediary member 106) or hanging element 260.

The weight of the working machine positioned at the right side of the operator's body imposes a larger load to the left shoulder belt 216Le than to the right shoulder belt 216Ri. When the working machine is moved largely, pulling force F (FIG. 1) tends to act on the left shoulder belt 216Le. Nevertheless, in the arrangement where the extending direction of the shoulder-fitting portion is inherently shaped to align with the direction of pulling force F, such pulling force F, even if acting on the left shoulder belt 216Le, does not invite changes in position and shape of the shoulder-fitting portion of the left shoulder belt 216Le. As a result, the shoulder-fitting portion of the left shoulder belt 216Le can keep fitting on the operator's shoulder even if a locally biased pulling force acts on the left shoulder belt 216Le. Furthermore, since the shoulder-fitting portion of the left shoulder belt 216Le does not suffer deformation such as torsion or twist even upon application of a locally biased pulling force on the left shoulder belt 216Le, the belt 216Le is relieved from degrading in durability.

In shoulder harnesses for use with relatively heavy working machines, a shoulder belt to be worn on the left shoulder of an operator may be originally given a shape that curves or slants at a portion that will fit on an area from the front shoulder to the breast of the operator when he/she wears the should harness.

The embodiment of the invention has been explained heretofore taking the shoulder harness 200 in which the back plate 204 is a mold of synthetic resin. The base portion 204*a* of the back plate 204, which is the back-fitting member to be worn on the back of an operator, may be made by combining a plurality of wide, flexible bands in form of a latticework, for example.

Figure 5:
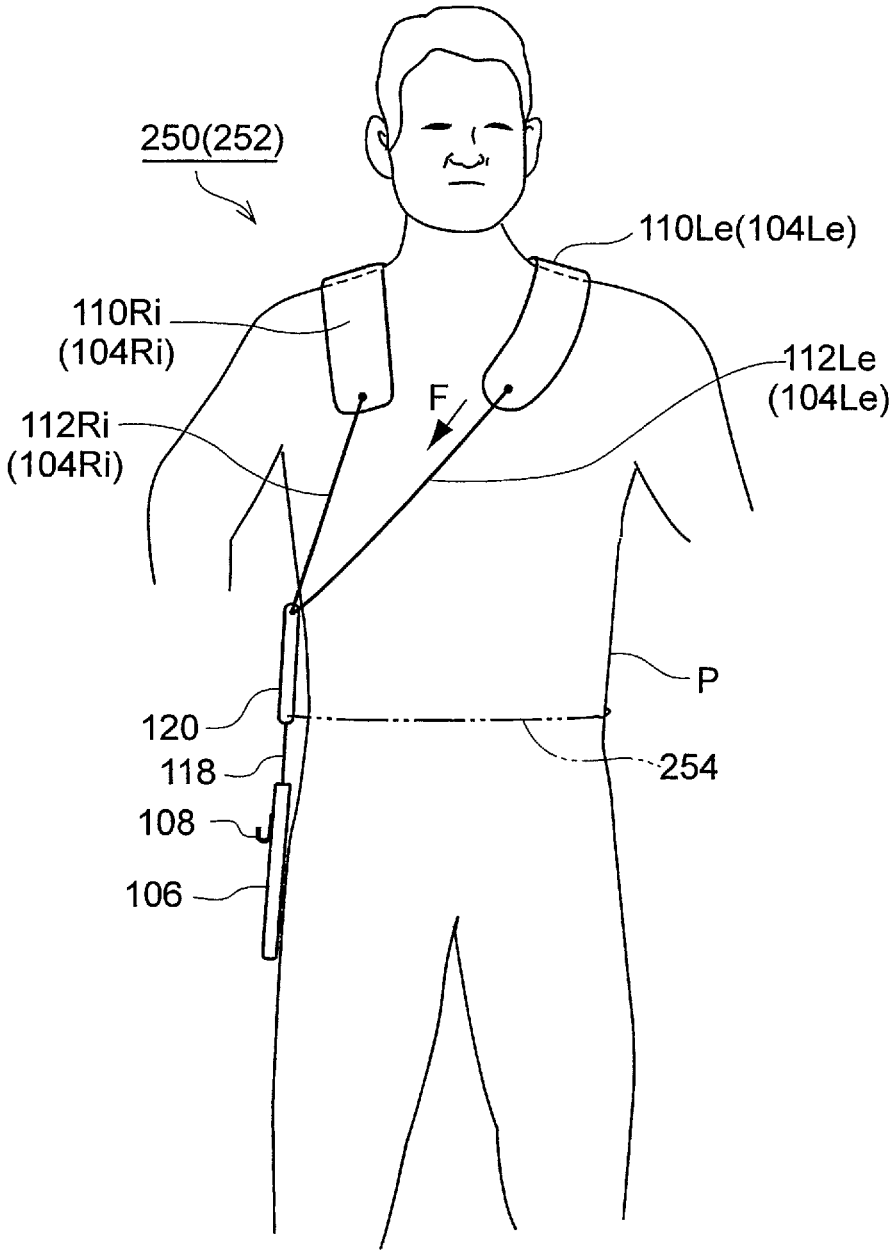
FIG. 5 illustrates a basic configuration of a shoulder harness that is a variation of the embodiment of the present invention.
Figure 6:
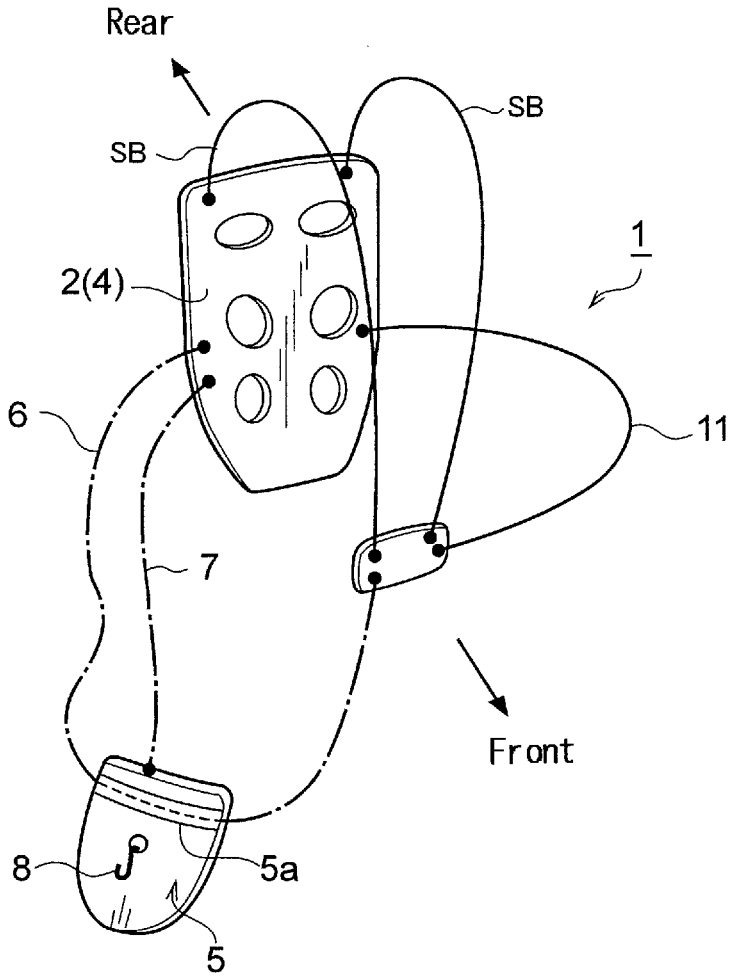
FIG. 6 shows a basic configuration of an existing shoulder harness.
Figure 7:
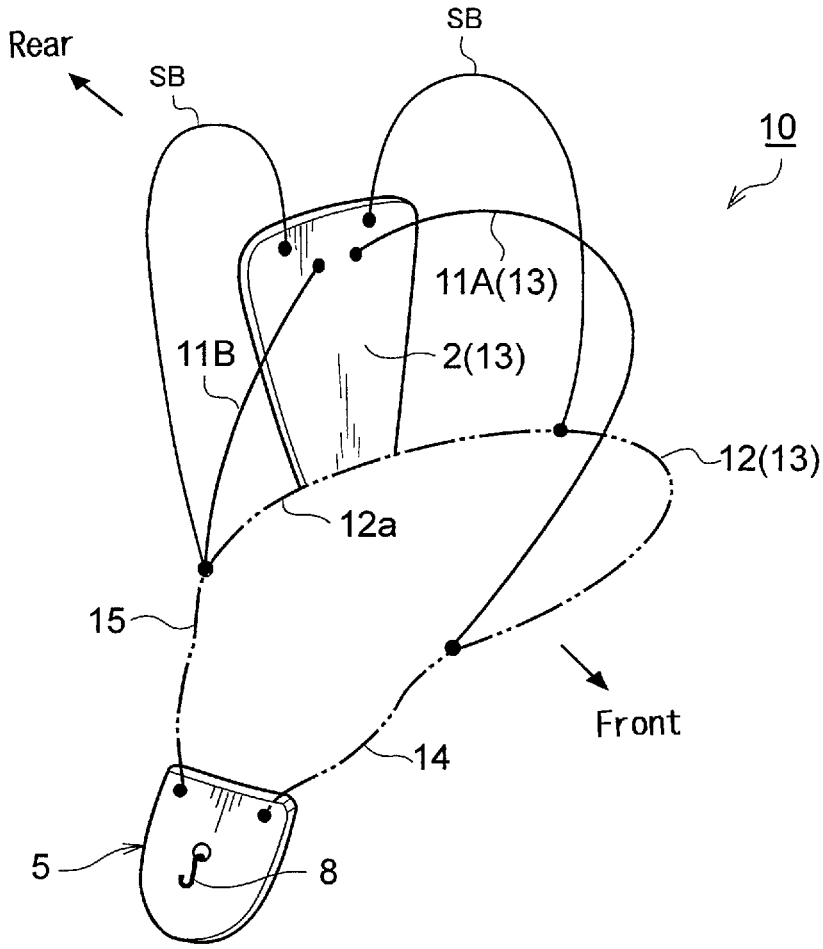
FIG. 7 shows a basic configuration of an existing shoulder harness of a different type.
Figure 8:
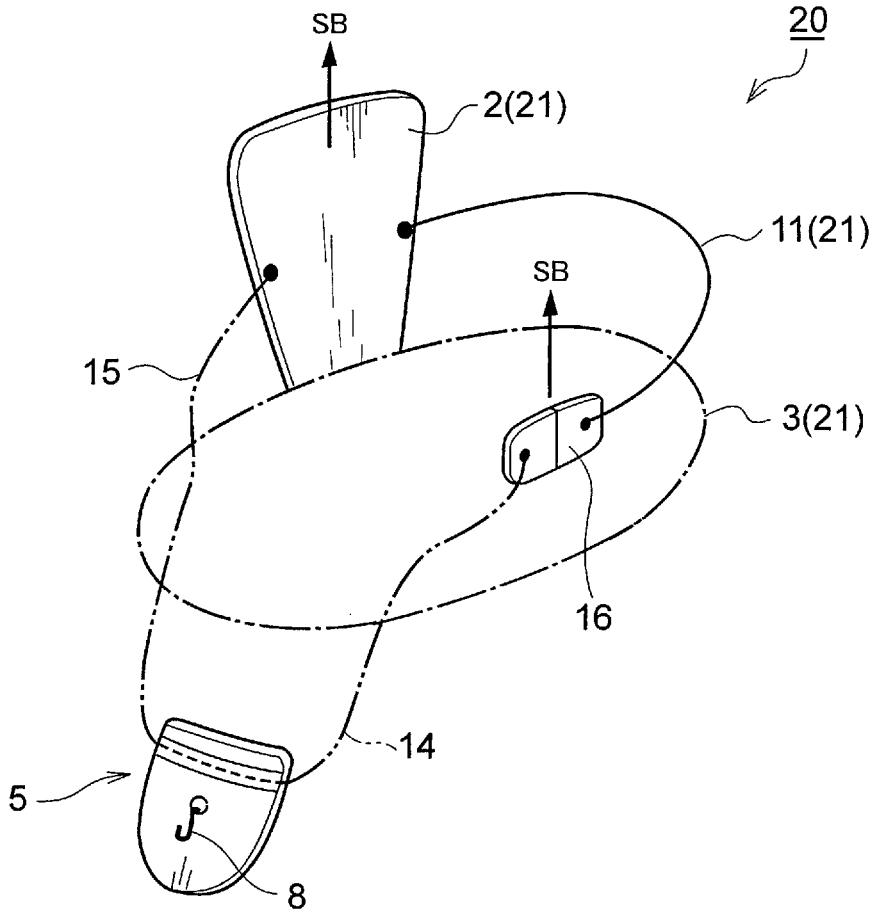
FIG. 8 schematically illustrates an existing shoulder harness of a still another type.
Figure 9:
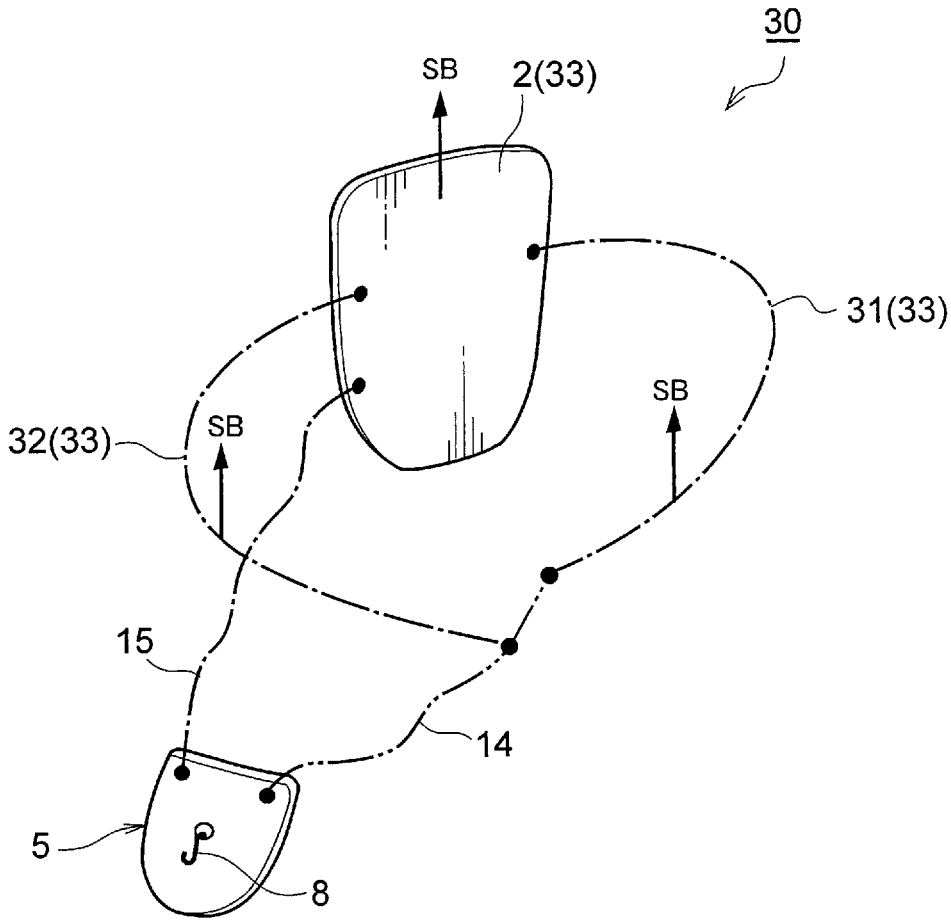
FIG. 9 schematically illustrates an existing shoulder harness of a yet another type.

Modification (FIG. 5)

FIG. 5 shows a shoulder harness 250 taken as a modification of the above-explained embodiment of the present invention. Explanation of components and elements of this modification common to those of the embodiment already explained with reference to FIG. 1 is omitted from the following description by labeling them with the same reference numerals. Thus, particular features, alone, of the modification are explained below.

The modified shoulder harness 250 shown in FIG. 5 has a harness network 252 that includes bilaterally asymmetric right and left shoulder belts 104Ri and 104Le like in the shoulder harness 100 shown in FIG. 1. In the shoulder harness 250 of FIG. 5, however, the right and left shoulder belts 104Ri and 104Le are connected directly to the intermediary plate member. This shoulder harness 250 of FIG. 5 preferably includes, and it is more preferably connected to the intermediary member 120. The waist belt 254 is preferably made of a stretchable material.

Also in the modified shoulder harness 250 shown in FIG. 5, the bilaterally asymmetric structure is employed for the right and left shoulder belts 104Ri, 104Le, in which the left shoulder belt 104Le opposite to the working machine (hip pad 106) has a shoulder-fitting portion 110Le extending diagonally or curved to the right toward the intermediary member 120. Therefore, even if a pulling force F from the working machine acts on the left shoulder belt 104Le, the shoulder-fitting portion 110Le of the left shoulder belt 104Le can be relieved from deformation or slippage, and it results in alleviating load to the operator's shoulder.

INDUSTRIAL APPLICABILITY

The present invention is suitable for use in all types of hand-held working machines that an operator can operate by hanging from around his/her waist or hip. These working machines include, for example, brush cutters, pole pruners (working machines having a cutting portion of a chainsaw type at one end of a long main pipe) and shaft hedge trimmers (hand-held working machines having a reciprocal cutter portion at one end of a long main pipe), among others.

What is claimed is:

1. A shoulder harness having a harness network composed of at least a back-fitting plate to be worn on the back of an operator and right and left shoulder belts to be worn on the right and left shoulders of the operator, and having a hanging element with a hip pad connected to the harness network, such that a working machine can be retained on the hanging element, comprising:

the right and left shoulder belts having an asymmetric configuration: and a first band is connected to a front end of a shoulder-fitting portion of one of said right and left shoulder belts as a first shoulder belt, which said first shoulder belt is opposite from one side of the shoulder harness where the hanging element is capable of having the working machine retained therefrom, wherein said first band is capable of transmitting a pulling force applied to said first shoulder belt from said working machine, wherein a front portion of said first shoulder belt has a curved or slanted shape that extends toward the one side having the hanging element to align with the direction of said pulling force applied to said first shoulder belt from said working machine, and a second one of said right and left shoulder belts is a second shoulder belt that extends straight, and said second shoulder belt has a second band connected to a front end thereof, wherein the first and second shoulder belts have an asymmetric configuration with respect to said one side of the shoulder harness, wherein front ends of the first and second bands join at a juncture in front of a central part of the operator.

2. The shoulder harness according to claim 1, further comprising a releasable joint buckle provided at the juncture of the front ends of the right and left bands.

3. The shoulder harness according to claim 2, wherein the hanging element is suspended from an intermediary plate and said intermediary plate is connected to said releasable joint buckle juncture and said back-fitting plate.

4. The shoulder harness according to claim 3, further comprising a side-fitting belt that extends laterally along the other side of the operator's body that is opposite from the side where the hanging element is located, said side fitting belt being connected to the back-fitting plate and the releasable joint buckle.

5. The shoulder harness according to claim 2, further comprising a side-fitting belt that extends laterally along the other side of the operator's body that is opposite from the side where the hanging element is located, said side fitting belt being connected to the back-fitting plate and the releasable joint buckle.

6. The shoulder harness according to claim 2, further comprising a waist belt to be worn on the operator's waist, said waist belt detachably connected to said back-fitting plate and said intermediary plate.

7. The shoulder harness according to claim 2, wherein said hanging element is suspended from said intermediary plate by a belt.

8. The shoulder harness according to claim 1, wherein the back-fitting plate comprises a base body and right and left extensions, wherein the back-fitting plate is an integrally molded member comprising synthetic resin, wherein the right and left extensions are connected to respective right and left shoulder belts, and the left extension gradually curves toward a distal front end thereof and the right extension extends straight.

* * * * *